United States Patent [19]

Kamimura

[11] 4,167,891

[45] Sep. 18, 1979

[54] HYDRAULIC ACTUATOR

[75] Inventor: Toshio Kamimura, Gifu, Japan

[73] Assignee: Teijin Seiki Company, Limited, Osaka, Japan

[21] Appl. No.: 821,193

[22] Filed: Aug. 2, 1977

[30] Foreign Application Priority Data

Aug. 12, 1976 [JP] Japan ..... 51-96423

[51] Int. Cl.[2] ..... F15B 15/22; F01B 25/26; F15B 15/26

[52] U.S. Cl. ..... 91/408; 91/410; 92/5 L; 92/24; 92/27; 92/108

[58] Field of Search ..... 92/23, 24, 27, 28, 60, 92/85 B, 108, 5 R, 5 L, 113; 91/6, 29, 407, 408, 409, 410

[56] References Cited

U.S. PATENT DOCUMENTS

| | | | |
|---|---|---|---|
| 2,803,222 | 8/1957 | Bukoff | 91/408 |
| 3,180,234 | 4/1965 | Crawley | 92/24 |
| 3,605,568 | 9/1971 | Nepp | 92/28 |
| 3,946,642 | 3/1976 | Bogenschutz | 92/27 |
| 3,986,438 | 10/1976 | Wittren | 92/108 |

FOREIGN PATENT DOCUMENTS

| | | | |
|---|---|---|---|
| 565127 | 10/1944 | United Kingdom | 92/24 |
| 1236020 | 6/1971 | United Kingdom | 92/23 |

*Primary Examiner*—Abraham Hershkovitz
*Attorney, Agent, or Firm*—Cushman, Darby & Cushman

[57] ABSTRACT

Herein disclosed is a hydraulic actuator which comprises an outer cylinder; an inner cylinder attached at its one end to the axial inner one end of the outer cylinder in coaxial relation with the outer cylinder to define an annular gap between the outer and inner cylinders; a piston having a hollow bore axially extending from its one end to the other end and closed at the other end and slidably received in the annular gap; and a locking mechanism temporarily locking the piston with the outer cylinder upon the farthest movement of the piston to the other end thereof; the locking mechanism including a locking member coupled with one end portion of the piston and which is radially movable, a ram resiliently received in the other end of the inner cylinder and having an inclined stepped portion and a hollow bore axially extending from its one end to the other end and opened at the other end, and an annular locking groove formed at the inner periphery of the other end of the outer cylinder, whereby the locking member is brought into engagement with the stepped portion and then received in the locking groove to temporarily lock the piston with the outer cylinder.

3 Claims, 9 Drawing Figures

HYDRAULIC ACTUATOR

This invention relates to a hydraulic actuator and more particularly to an actuator comprising two independent chambers, i.e., normal and emergency chambers.

It is a common practice to use such a hydraulic actuator for actuating and locking undercarriages and flaps of aircrafts.

Conventional hydraulic actuators were each provided with only one normal chamber in a cylinder in which a piston was slidably received. It was therefore encountered that the hydraulic actuator was frequently not actuated since any fluid under pressure is not fed to the cylinder upon breakage of a pump and pipes or since the fluid is flowed exteriorly of the cylinder to be decreased in pressure upon breakage of the cylinder. This resulted in operational troubles for the aircraft. On the other hand, the fluid under pressure is required enough to be filled in the cylinder for projecting and retracting the piston. However, conventional hydraulic actuators required a large amount of fluid which made a reservoir relatively large in size and heavy in weight. In addition, almost all the conventional internal locking mechanisms of the hydraulic actuators each comprised main parts provided at one end of the piston and locking members slidably moved together with the piston by a ram while being in contact with the inner peripheral surface of the cylinder. It was extremely difficult to apply the above conventional locking mechanism to a hydraulic actuator with two chambers in a cylinder since an inner cylinder was provided in the cylinder. Even if such application were possible, there might entail such disadvantages as large size and heavy weight to the hydraulic actuator. The locking members might cause damages to the inner surface of the cylinder to develop into a serious breakage to the cylinder since the locking members were slidably moved by the ram in pressing contact with the inner peripheral surface of the cylinder. There has been provided a variety of damping mechanisms for reducing the retracting speed of the piston in the final piston retracting stage for a hydraulic actuator of the type which has only one chamber in the conventional cylinder. It may be considered that such a damping mechanism is applied to a hydraulic actuator having two independent chambers. However, the actuator may be large in size and can not bring about a desired damping effect.

It is therefore an object of the present invention to provide a hydraulic actuator comprising normal and emergency chambers having a most preferable locking mechanism.

It is another object of the present invention to provide a hydraulic actuator having an excellent damping effect and which is small in size as well as light in weight.

The foregoing objects are attained by a hydraulic actuator of the present invention which comprises: an outer cylinder; an inner cylinder attached at its one end to the axial inner one end of the outer cylinder in coaxial relation with the outer cylinder to define an annular gap between the outer and inner cylinders; a piston having a hollow bore axially extending from its one end to the other end and closed at the other end and slidably received in the annular gap; and a locking mechanism temporarily locking the piston with the outer cylinder upon farthest movement of said piston to the other end thereof; the locking mechanism including a locking member coupled with one end portion of the piston to be radially moved, a ram resiliently received in the other end of the inner cylinder and having an inclined stepped portion and a hollow bore axially extending from its one end to the other end and opened at the other end, and an annular locking groove formed at the inner periphery of the other end of the outer cylinder, whereby the locking member is brought into engagement with the stepped portion and then received in the locking groove to temporarily lock the piston with the outer cylinder. The other aspect of the hydraulic actuator comprises a damper piston having an outer diameter smaller than the inner diameter of the ram to define an annular gap therebetween and received in the hollow bore of the ram whereby fluid under pressure remaining in a chamber formed by the piston, the ram and the damper piston flows through the annular gap between the ram and the damper piston into the inner cylinder subsequent to the closed end of the piston being brought into engagement with said damper piston.

The above and other objects, features and advantages of the present invention will become clear from the following particular description of the invention and the appended claims, taken in conjunction with the accompanying drawings which show by way of example a preferred embodiment of the present invention.

Figure 6:
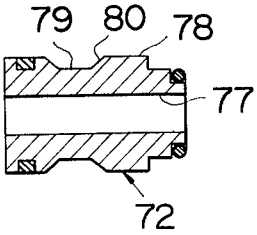
FIG. 6 is a cross-sectional view of a switch piston to be assembled in the hydraulic actuator.
Figure 7:
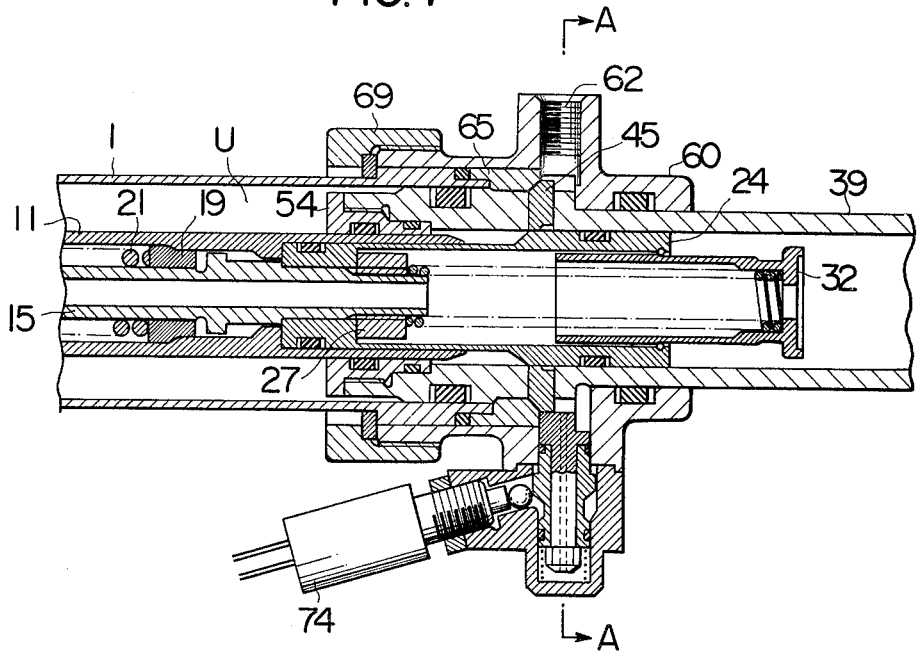
FIG. 7 is a fragmentary cross-sectional view of the hydraulic actuator showing a piston under its locked state.

In the drawings except for FIG. 6, the term "one end" is intended to mean a left hand side of each of all the parts and the term "the other end" is likewise intended to mean a right hand side of each of all the parts.

Figure 1:
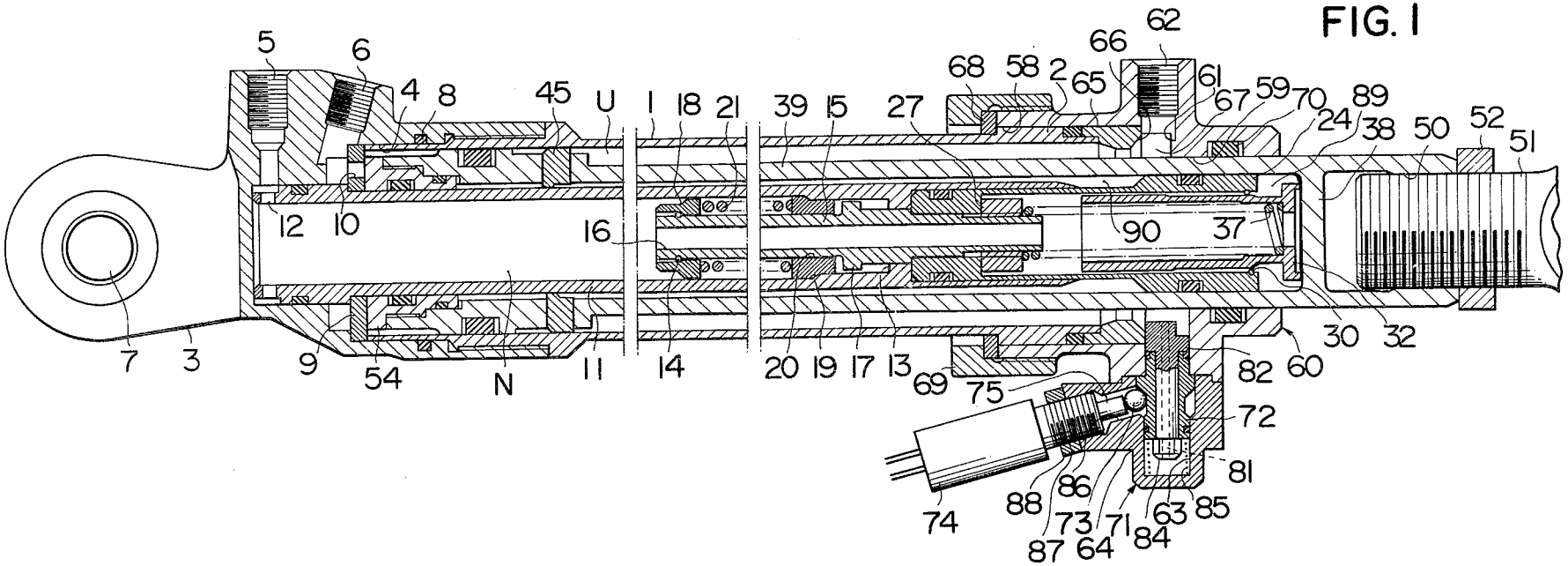
FIG. 1 is a cross-sectional view of one embodiment of a hydraulic actuator in accordance with the present invention.
Figure 2:
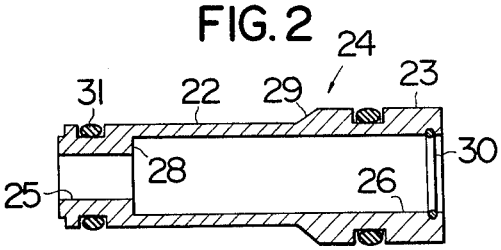
FIG. 2 is a cross-sectional view of a ram to be assembled in the hydraulic actuator.
Figure 3:
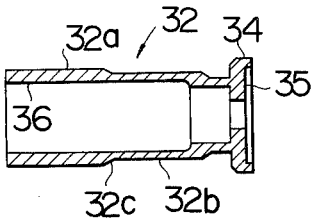
FIG. 3 is a cross-sectional view of a damper piston to be assembled in the hydraulic actuator.

Referring now to the drawings and in particular to FIG. 1, the reference numeral 1 indicates a cylindrical member which has at one end periphery a threaded portion and at the other end periphery an annular protrusion 2. A cylinder head 3 is adapted to have a closed bore 4 having a threaded portion in threaded engagement with the threaded portion of the cylindrical member 1. The cylinder head 3 is formed with a first port 5 and a second port 6 spacedly arranged from its one end to the other end and opened at the closed bore 4, the first port 5 being in communication with a suitable normal oil feeding source not shown while the second port 6 being in communication with atmosphere under a normal condition but communicatable with a suitable emergency oil feeding source also not shown under an emergency condition. The cylinder head 3 is provided at its one end with a clamping bore 7 which is used to attach the cylinder head 3 with a body of an aircraft not shown. On the inner peripheral wall of the closed bore 4 is formed an annular groove in which an O-shaped ring 8 is received to prevent oil leakage between the cylindrical member 1 and the cylinder head 3. An annular stop member 9 has an axially extending bore 10 and is retained by the cylindrical member 1 and cylinder head 3. An inner cylinder 11 is attached at its one end to the bottom of the closed bore 4 of the cylinder head 3 in coaxial relation with the cylindrical member 1 by means of the stop member 9 which is in turn urged toward the clamping bore 7 by the cylindrical member 1. At one end portion of inner cylinder 11 is formed a plurality of radial bores 12 which serve to flow fluid under pressure from the first port 5 to a normal chamber N which is formed in the inner cylinder 11. The inner cylinder 11 is smaller in diameter than the cylindrical member 1 to form therebetween an annular gap, i.e., an emergency chamber U which is in communication with the second port 6 through the bore 10 of the stop member 9. At the inner periphery of the other end portion of the inner cylinder 11 is formed an annular projection 13 which slidably receives a rod 15 and is engageable with an annular stop projection 17 formed on the axially central portion of the rod 15. The rod 15 is formed to have an axially extending bore 16 opened at axial both ends, having a locking ring 14 at its one end outer periphery and a threaded portion at the other end outer periphery. It is to be noted from the foregoing description that when the stop projection 17 is moved to be engaged with the annular projection 13 the rod 15 is prevented from further movement toward the other end thereof by the annular projection 13. A first stop ring 18 is retained on one end of the rod 15 in engagement with the locking ring 14 which is thus prevented from being disengaged from the rod 15. A second stop ring 19 is formed with a bore 20 slidably engaged with the rod 15 while being stopped at a position shown in FIG. 1 in engagement with the inner cylinder 11. Disposed between the first stop ring 18 and the second stop ring 19 to surround the rod 15 is a compression coil spring 21 which serves to urge the rod 15 toward the one end thereof through the first stop ring 18 and the locking ring 14. As best shown in FIG. 2, a ram generally indicated at 24 includes a small diameter portion 22 having an outer diameter substantially equal to the inner diameter of the inner cylinder 11 and a large diameter portion 23 having an outer diameter larger than the outer diameter of the inner cylinder 11 and substantially equal to the inner diameter of a piston which will become apparent as the description proceeds. On the other hand, the ram 24 includes a small diameter bore 25 having an inner diameter substantially equal to the outer diameter of the rod 15 and a large diameter bore 26 having an inner diameter larger than that of the small diameter bore 25. The ram 24 is slidably received in the inner cylinder 11 with the small diameter portion 22 in engagement with the other end inner periphery of the inner cylinder 11 and with the small diameter bore 25 in engagement with the other end outer periphery of the rod 15. Indicated at the reference numeral 27 is a nut which is in threaded engagement with the threaded portion formed on the other end outer periphery of the rod 15 so as to be abutted at its one end face against a stepped portion 28 formed between the small diameter bore 25 and the large diameter bore 26. The nut 27, therefore, serves to prevent the rod 15 from further movement toward its one end from the axial position shown in FIG. 1 since the nut 27 is stopped by the annular projection 13 through an annular protrusion formed at one end of the ram 24. The ram 24 further includes an inclined portion 29 connecting small diameter portion 22 and the large diameter portion 23 and a locking ring 30 provided at the other end inner periphery of the large diameter bore 26. On the outer peripheral wall of the small diameter portion 22 of the ram 24 is formed an annular groove in which an O-shaped ring 31 is received to prevent oil leakage through the inner cylinder 11 and the ram 24. As best shown in FIG. 3, a damper piston generally represented at 32 includes a large diameter portion **32*a*, a small diameter portion 32*b* and an inclined portion 32*c* connecting the large diameter portion 32*a* and the small diameter portion 32*b*. The outer diameter of the large diameter portion 32*a* is slightly smaller than the inner diameter of the large diameter bore 26 of the ram 24 while the outer diameter of the small diameter portion 32*b* is smaller than the inner diameter of the locking ring 30. The damper piston 32 is received in the large diameter bore 26 of the ram 24, wherein an annular gap is defined by the large diameter portion 32*a* of the damper piston 32 and the large diameter bore 26 of the ram 24 and also an additional annular gap is defined by the small diameter portion 32*b* of the damper piston 32 and the locking ring 30 thereby to allow fluid under pressure to flow through the above annular gaps which makes it possible to impart a damping effect as described hereinafter. Additionally, the outer diameter of the large diameter portion 32*a* of the damper piston 32 is adapted to be larger than the inner diameter of the locking ring 30 so that the damper piston 32 is prevented from being moved toward the other end thereof from an axial position where the inclined portion 32*c* is engaged with the locking ring 30. The damper piston 32 further includes an annular flange 34 integrally formed at the other end of the small diameter portion 32*b* and having an outer diameter smaller than that of the large diameter portion 23 of the ram 24 and an end face at its other end to be sealingly engagable with a bottom portion of a main piston which will be described hereinafter. An annular recess 35 is formed at the other end face of the annular flange 34 to have a diameter larger than the outer diameter of the large diameter portion 32*a* of the damper piston 32. A through axial bore 36 is formed in the damper piston 32** to axially extend from its one end to the other end to permit fluid under pressure to be passed therethrough.

With reference again to FIG. 1, a compression coil spring 37 is accommodated in the ram 24 and the damper piston 32 to have one end engaged with the other end face of the nut 27 and the other end engaged with the annular flange 34 so as to urge the damper piston 32 toward the other end thereof.

Figure 4:
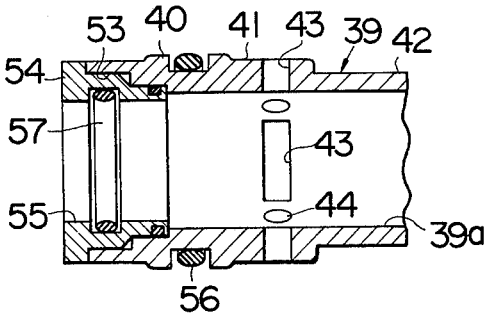
FIG. 4 is a fragmentary cross-sectional view of a main piston and a retainer to be assembled in the hydraulic actuator.
Figure 5:
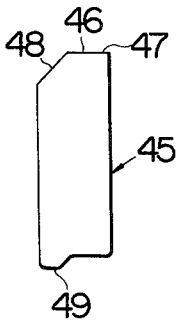
FIG. 5 is a front view of a locking member to be assembled in the hydraulic actuator.
Figure 8:
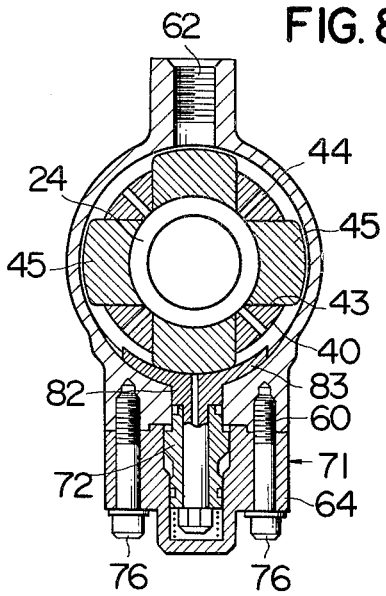
FIG. 8 is a cross-sectional view as seen from the lines A—A in FIG. 7.

A main piston generally indicated at 39 is particularly shown in FIG. 4 to include a large diameter portion 40 having an outer diameter substantially equal to the inner diameter of the cylindrical member 1, an intermediate diameter portion 41 having an outer diameter slightly smaller than that of the large diameter portion 40, and a small diameter portion 42 having an outer diameter smaller than that of the intermediate diameter portion 41, the intermediate diameter portion 41 connecting the large and small diameter portions 40 and 42. The main piston 39 is designed to have a hollow bore 39*a* having an inner diameter substantially equal to the outer diameter of the large diameter portion 23 of the ram 24 and axially extending from its one end to the other end but closed at the other end by a bottom portion 38 which is sealingly engagable with the end face of the annular flange 34 of the damper piston 32. Four radial locking bores 43 are formed at a circumferencially equi-distant spacing to be opened at the outer and inner peripheries of the intermediate diameter portion 41 of the main piston 39 so as to slidably receive locking members 45, respectively. Four through radial bores 44 are each arranged between the adjacent every two locking bores 43 to be opened at the outer and inner peripheries of the main piston 39. As best shown in FIGS. 5 and 8, each of the locking members 45 is contoured to have an arcuate portion 47 curved equally to the curvature of the inner periphery of a stop member 65 at the radially outer end face 46 thereof, and an inclined portion 48 slantedly formed at one end portion of the curved portion 47. Each of the locking members 45 is further contoured to have at its radially innermost end face 49 a curvature substantially equal to that of the large diameter portion 23 of the ram 24. Referring again to FIG. 1, a threaded bore 50 is formed at the other end of the main piston 39 and is in threaded engagement with a connecting rod 51 to be connected with a flapper or the like of the aircraft. A lock nut 52 is also in threaded engagement with the connecting rod 51 to prevent the ready release of the connecting rod 51. Referring again to FIG. 4, a threaded bore 53 is internally formed at one end of the main piston 39 to be in threaded engagement with a cylindrical threaded retainer 54 which is formed with an axial bore 55 having an inner diameter substantially equal to the outer diameter of the inner cylinder 11. The retainer 54 and the main piston 39 are disposed in the emergency chamber U with the outer periphery of the inner cylinder 11 slidably engaging the inner periphery of the axial bore 55 of the retainer 54 and with the inner periphery of the cylindrical member 1 slidably engaging the outer periphery of the large diameter portion 40 of the main piston 39. On the outer peripheral wall of the large diameter portion 40 of the main piston 39 is formed an annular groove in which an O-shaped ring 56 is received to prevent oil leakage through between the cylindrical member 1 and the main piston 39. Additionally, on the inner periphery of the axial bore 55 of the retainer 54 is formed an annular groove in which an O-shaped ring 57 is received to prevent oil leakage through between the inner cylinder 11 and the retainer 54.

Referring again to FIG. 1, a cylinder end member generally indicated at 60 includes an axial bore 58 internally formed to extend from its one end toward the other end and having an inner diameter substantially equal to the outer diameter of the annular protrusion 2 of the cylindrical member 1, and an additional axial bore 59 internally formed to extend from the other end toward its one end in communication with the axial bore 58 by a stepped face 61 and having an inner diameter substantially equal to the outer diameter of the small diameter portion 42 of the main piston 39. At the central portion of the cylinder end member 60 is provided a third port 62 in communication with a proper oil feeding source not shown. At the circumferential portion of the cylinder end member 60 opposite to the third port 62 is provided a cover 64 which has a radial closed bore 63 therein. The stop member 65 is formed with a slanted face 66 inclined at an angle substantially equal to the inclined portion 48 of the locking member 45 and is securely received in the axial bore 58. The slanted face 66, the inner periphery of the cylinder end member 60, and the stepped face 61 constitutes as a whole an annular locking groove 67. The cylinder end member 60 is secured to the other end periphery of the cylindrical member 1 through a split ring 68 by a lock nut 69 with the small diameter portion 42 of the main piston 39 slidably engaging the inner periphery of the additional axial bore 59. The previously mentioned cylindrical member 1, cylinder head 3, cylinder end member 60, stop member 65, split ring 68, and lock nut 69 constitutes as a whole an outer cylinder described in the present invention. On the inner periphery of the additional axial bore 59 is formed an annular groove in which an O-shaped ring 70 is received to prevent oil leakage through between the cylinder end member 60 and the main piston 39. The reference numeral 71 generally indicates a detecting mechanism for detecting positions of the locking members 45. The detecting mechanism 71 includes a switch piston 72 slidably received in the closed bore 63 of the cover 64, and a switch device 74 fixedly mounted on the cover 64 and having a detecting piston 75 transmitting the reciprocation of the switch piston 72 to the switch device 74 through a spherical member 73 for making the switch device 74 "on" and "off". The cover 64 is securely connected to the cylinder end member 60 by means of a plurality of bolts 76 as best shown in FIG. 8. The switch piston 72 is particularly shown in FIG. 6 to comprise a radial bore 77 formed therein, a large diameter portion 78 to be engageable with the spherical member 73, a small diameter portion 79 having an outer diameter smaller than that of the large diameter portion 78, and an inclined portion 80 interconnecting the large and small diameter portions 78 and 79. An intermediate switch member 82 is inserted in the radial bore 77 of the switch piston 72 and has a threaded portion formed at the radially outer end periphery thereof. The intermediate switch member 82 is securely retained in the switch piston 72 by screwing a nut 84 onto the threaded portion thereof so that the intermediate switch member 82 is reciprocated in unison with the switch piston 72. A radial bore 81 is formed in the intermediate switch member 82 which has a radially inner end integrally supporting an arcuate member 83. The arcuate member 83 is designed to extend circumferentially of the cylinder end member 60 to be engaged with only one of the locking members 45. Within the closed bore 63 is accommodated a compression coil spring 85 which radially inwardly urges the switch piston 72, the intermediate switch member 82 and the locking member 45 engaging the intermediate switch member 82. The cover 64 is formed with an inclined bore 86 which has an inner diameter slightly larger than the diameter of the spherical member 73 to allow the spherical member 73 to be moved along the axial direction of the inclined bore 86. The switch device 74 is formed at its forward periphery with a threaded portion 87 which is in threaded engagement with the cover 64 to maintain the axial lines of the switch device 74 and the switch piston 72 at a certain acuate angle. A lock nut 88 is held in engagement with the threaded portion 87 for the purpose of adjustment of positions of the switch device 74.

The operation of the hydraulic actuator thus constructed will be explained hereinafter.

At the preliminary stage, fluid under pressure in the third port 62 is made higher in pressure than that in the first port 5 and the second port 6 is in communication with atmosphere so that the main piston 39 is held to assume a first axial position where the retainer 54 is in abutting engagement with the stop member 9. At this time, the rod 15 assumes a projected position where the ram 24 is in abutting engagement with the annular projection 13 by the action of the compression coil spring 21. The damper piston 32 is also kept in the ram 24 with the other end face thereof being sealingly engaged with the bottom portion 38 of the main piston 39 since it is urged against the bottom portion 38 of the main piston 39 by the compression coil spring 37. The locking members 45 are also held at their radially outer end faces 46 in engagement with the inner periphery of the cylindrical member 1 and at their radially inner end face 49 in engagement with the outer periphery of the inner cylinder 11. The switch piston 72 also assumes a radially innermost position since the compression coil spring 85 urges the switch piston 72. The spherical member 73 is thus held in engagement with the small diameter portion 79 of the switch piston 72, whereupon the detecting rod 75 assumes a projected position, thereby making the switch device 74 "off".

In order to cause the main piston 39 to be projected to a second axial position from the first axial position, fluid under pressure in the first port 5 is made higher in pressure than that in the third port 62. At this time, fluid under pressure is admitted into the damper piston 32 from the first port 5 through the radial bores 12, the normal chamber N and the bore 16 of the rod 15. The damper piston 32 is therefore somewhat displaced toward the rod 15 against the compression coil spring 37, thereby giving rise to a small gap between the other end of the damper piston 32 and the bottom portion 38 of the main piston 39. Such displacement of the damper piston 32 is caused by the reason that a force P to move the damper piston 32 toward the rod 15 becomes larger than a force Q to move the damper piston 32 toward the connecting rod 51. The force P is a value which is obtained by multiplying the pressure of fluid under pressure and an area obtained by deducting the cross-sectional area of the large diameter portion 32*a* from the cross-sectional area of the annular recess 35. The force Q, on the other hand, is a resilient force of the compression coil spring 37. As a result, the fluid under pressure is admitted into a chamber 89 defined by the annular flange 34, the ram 24 and the main piston 39, thereby causing the main piston 39 to be projected. The damper piston 32 is then moved toward the bottom portion 38 of the main piston 39 by the resilient force of the compression coil spring 37 until the inclined portion 32*c* is brought into engagement with the locking ring 30. At this time, the fluid under pressure in the emergency chamber U is discharged through the third port 62. Although the ram 24 is exerted by a force R to be moved toward the cylinder head 3, the ram 24 can not be moved since it is held in abutting engagement with the annular projection 13 of the inner cylinder 11. The force R is a value which is obtained by adding a resilient force of the compression coil spring 21 acting upon the ram 24 through the first and second stop rings 18 and 19, the rod 15 and the nut 27 and a fluid force obtained by multiplying the pressure of the fluid under pressure and an area S. The area S is obtained by deducting the cross-sectional area of the small diameter portion 22 of the ram 24 from the cross-sectional area of the large diameter portion 23 of the ram 24. The main piston 39 is further projected toward the cylinder end member 60 to cause the radially inner end faces 49 of the locking members 45 to be brought into engagement with the inclined portion 29 of the ram 24. The ram 24 is at this time urged by the locking members 45 to be moved slightly toward the bottom portion 38 of the main piston 39 since the foregoing force R is in turn smaller than a force to move the main piston 39 toward the connecting rod 51. Simultaneously with the movement of the ram 24, the locking members 45 are radially outwardly moved along the inclined portion 29 of the ram 24. Only one locking member 45 then comes to be engagement with the arcuate member 83 of the intermediate switch member 82 since the arcuate member 83 is adapted to sufficiently extend circumferentially. The intermediate switch member 82 is then radially outwardly moved and concurrently the switch piston 72 is radially outwardly moved against the compression coil spring 85, with the result that the spherical member 73 is urged toward the switch device 74 by the inclined portion 80 of the switch piston 72, thereby retracting the detecting rod 75. Subsequently, a stepped portion interconnecting the small diameter portion 42 and the intermediate diameter portion 41 of the main piston 39 is brought into abutting engagement with the stepped face 61 of the cylinder end member 60 and the inclined portions 48 of the locking members 45 are brought into complete engagement with the slanted face 66 of the stop member 65 to cause the main piston 39 to assume the second axial position, whereupon the main piston 39 is completely locked. The main piston 39 is thus by no means moved in any direction even if any external force is exerted upon the main piston 39, which makes the switch device 74 "on". The radially inner end faces 49 of the locking members 45 are at this time released from the inclined portion 29 of the ram 24 to be brought into engagement with the large diameter portion 23 of the ram 24, with the result that the ram 24 is moved toward the cylinder head 3 by the action of the previously mentioned force R until the ram 24 is brought into abutting engagement with the annular projection 13.

In order to cause the main piston 39 to be released from the locked condition, the fluid under pressure in the first port 5 is decreased in pressure and the fluid under pressure in the third port 62 is slightly raised in pressure as compared to that in the first port 5, whereupon the fluid under pressure is introduced, through the third port 62, the chamber U and the through bore 44, into a chamber 90 defined by the small diameter portion 22 of the ram 24 and the main piston 39. Although the ram 24 is exerted by a force T to be moved toward the connecting rod 51, the ram 24 can not be moved since the resilient force of the compression coil spring 21 is larger than the force T which is obtained by multiplying the pressure of the fluid under pressure and an area V. The area V is obtained by deducting the cross-sectional area of the small diameter portion 22 of the ram 24 from the cross-sectional area of the large diameter portion 23 of the ram 24. When the pressure of the fluid under pressure in the third port 62 is then raised to obtain a desired pressure difference between the pressures in the first port 5 and the third port 62, the ram 24 is moved toward the connecting rod 51 against the compression coil spring 21 since the force T becomes larger than the resilient force of the compression coil spring 21. Although the main piston 39 is exerted by a force W to be moved toward the cylinder head 3, the main piston 39 can not be moved since the inclined portions 48 of the locking members 45 are completely in engagement with the slanted face 66 of the stop member 65. The force W is a value which is obtained by multiplying the pressure of the fluid under pressue and an area X. The area X is obtained by adding two values one of which is obtained by deducting the cross-sectional area of the small diameter portion 42 of the main piston 39 from the cross-sectional area of the large diameter portion 40 of the main piston 39 and the other of which is obtained by deducting the cross-sectional area of the inner cylinder 11 from the cross-sectional area of the large diameter portion 23 of the ram 24. When the ram 24 is moved toward the connecting rod 51, there is created a gap between the radially inner faces 49 of the locking members 45 and the outer periphery of the ram 24, with the result that one of the locking members 45 in engagement with the arcuate member 83 of the intermediate switch member 82 is radially inwardly moved by the action of the resilient force of the compression coil spring 85 and a component of the force W while the remaining locking members 45 in disengagement from the arcuate member 83 is radially inwardly moved by the action of only the component of the force W. At this time, the spherical member 73 is moved from the large diameter portion 78 to the small diameter portion 79 along the inclined portion 80 of the switch piston 72 to cause the detecting rod 75 to be projected so that the switch device 74 is made "off". When the ram 24 is further moved toward the connecting rod 51, the locking members 45 are moved radially inwardly to assume a radially innermost position so that the main piston 39 is further retracted as the stop member 65 allows the locking members 45 to pass therethrough. At this time, the fluid under pressure in the main piston 39 is discharged through the normal chamber N and the radial bore 12 to the first port 5. When the main piston 39 is further retracted to cause the bottom portion 38 of the main piston 39 to be brought into sealed abutting engagement with the annular flange 34 of the damper piston 32, the damper piston 32 is caused to be moved toward the rod 15 by the movement of the main piston 39. The fluid under pressure in the chamber 89 is simultaneously flowed through the annular gaps, one of which is defined by the large diameter portion 32*a* and the large diameter bore 26 and the other of which is defined by the small diameter portion 32*b* and the locking ring 30, into the ram 24 so that the main piston 39 and the damper piston 32 are slowly moved toward the cylinder head 3 against the compression coil spring 37, thereby causing a damping effect to the main piston 39 at the final retracted stage. The degree of the damping effect can be adjusted by varying the gap between the large diameter portion 32*a* and the large diameter bore 26. When the main piston 39 is further retracted to cause the retainer 54 to be brought into abutting engagement with the stop member 9, feeding of the fluid under pressure through the third port 62 is stopped. At this time, the ram 24 is moved toward the cylinder head 3 until the ram 24 is brought into abutting engagement with the annular projection 13 of the inner cylinder 11 by the action of the compression coil spring 21.

In the event that there may be caused a crack in the main piston 39 or a not-shown pipe connected with the first port 5 resulting in leakage of the fluid under pressure and thus pressure decrease of the fluid under pressure in the normal chamber N, a large amount of high fluid under pressure is fed into the emergency chamber U from the second port 6 to cause the main piston 39 to be projected.

The previously mentioned operation has been explained about only one cycle of the hydraulic actuator exemplifying the present invention and such cycle will be repeated.

Figure 9:
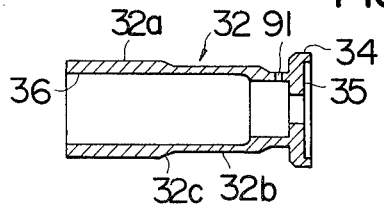
FIG. 9 is a cross-sectional view similar to FIG. 3 but showing another embodiment of the damper piston to be assembled in the hydraulic actuator in place of the ram shown in FIG. 3.

While there has been described about the case that a gap is formed between the ram 24 and the damper piston 32, the damper piston 32 may be formed to have at least one through radial bore 91 opened at its outer and inner peripheral faces to allow the fluid under pressure to pass therethrough as shown in FIG. 9 if desired. The normal chamber N may be used as an emergency chamber while the emergency chamber U may inversely be used as a normal chamber where desired.

According to the present invention as particularly explained in the above, a hydraulic actuator can be made small in size and light in weight without damaging the inner peripheral surface of an outer cylinder since a locking member is adaped to be retained in one end portion of a main piston, a ram is accommodated in the other end portion of an inner cylinder, and a locking groove is formed in the other end portion of the outer cylinder.

Although particular embodiments of the present invention have been shown and described, it will be obvious to those skilled in the art that various changes and modifications may be made without departing from the spirit and scope of the present invention.

What is claimed is:

1. A hydraulic actuator, comprising:

an outer cylinder having an inner one end and another end;

an inner cylinder having one end attached to the axial inner one end of said outer cylinder in coaxial relation with said outer cylinder to define an annular gap between said outer and inner cylinders and having a stop portion formed at an intermediate position of the inner periphery of said inner cylinder;

a piston having a hollow bore axially extending from one end of said piston to the other end thereof and being closed at said other end thereof and slidably received in said annular gap and being hermetically sealed at said one end of said piston to the inner periphery of said outer cylinder and the outer periphery of said inner cylinder;

a locking mechanism for temporarily locking said piston with said outer cylinder upon the farthest movement of said piston toward said another end of said outer cylinder; said locking mechanism including locking means radially movably received in said piston to be lockable with an annular locking groove formed at the inner periphery of said another end of said outer cylinder and axially slidably movable with respect to said outer and inner cylinders, a ram having a portion of a given diameter extending spaced from said inner cylinder toward the other end of said piston and hermetically slidably received in said piston, another portion of a diameter smaller than said given diameter extending from said given diameter portion toward said stop portion of said inner cylinder and hermetically received in said inner cylinder, an inclined portion connecting said portions having a given diameter and a smaller diameter, said ram further including a hollow bore axially extending from one end of said drum to the other end thereof and opened at said both ends of said ram, resilient means provided within said inner cylinder to urge said ram toward said stop portion of said inner cylinder; and port means including a first port opened at said one end of said inner periphery of said inner cylinder, a second port opened at said one end of the inner periphery of said outer cylinder for communicating with atmosphere under a normal condition and communicatable with an emergency oil feeding source under an emergency condition, and a third port opened at the other end of the inner periphery of said outer cylinder so that, when oil is fed through said first port and said piston is moved towards said another end of said outer cylinder, said locking member will be brought into engagement with said inclined portion of said ram and then received in said locking groove to temporarily lock said piston with said outer cylinder.

2. A hydraulic actuator as claimed in claim 1, which further comprises:

a damper piston having an outer diameter smaller than the inner diameter of said ram to define an annular gap therebetween and received in said hollow bore of said ram, whereby fluid under pressure remaining in a chamber formed by said piston, said ram and said damper piston flows through said annular gap between said ram and said damper piston into said inner cylinder subsequent to the closed end of said piston being brought into engagement with said damper piston.

3. A hydraulic actuator as set forth in claim 1, which further comprises:

a damper piston having an axial through bore opened at its outer and inner peripheral faces and received in said hollow bore of said ram and a radial through bore in said damper piston whereby fluid under pressure remaining in a chamber formed by said piston, said ram and said damper piston flows through said radial through bore through said axial bore and enters into said inner cylinder subsequent to the closed end of said piston being brought into engagement with said damper piston.

* * * * *